US009004887B2

(12) United States Patent
Chao et al.

(10) Patent No.: US 9,004,887 B2
(45) Date of Patent: Apr. 14, 2015

(54) THRUST PLATE FOR A HORIZONTAL SCROLL COMPRESSOR AND A HORIZONTAL SCROLL COMPRESSOR HAVING THE SAME

(75) Inventors: Linzhi Chao, Jiangsu (CN); Shuichong Fan, Jiangsu (CN); Chao Jiang, Jiangsu (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 121 days.

(21) Appl. No.: 13/996,881

(22) PCT Filed: Dec. 22, 2011

(86) PCT No.: PCT/US2011/066762

§ 371 (c)(1),
(2), (4) Date: Aug. 7, 2013

(87) PCT Pub. No.: WO2012/088387

PCT Pub. Date: Jun. 28, 2012

(65) Prior Publication Data

US 2013/0323105 A1 Dec. 5, 2013

(30) Foreign Application Priority Data

Dec. 22, 2010 (CN) ..... 2010 2 06801265

(51) Int. Cl.
*F03C 2/00* (2006.01)
*F03C 4/00* (2006.01)
(Continued)

(52) U.S. Cl.
CPC ..... *F04C 29/028* (2013.01); *F04C 18/0215* (2013.01); *F04C 18/0253* (2013.01); *F04C 23/008* (2013.01); *F04C 2240/56* (2013.01); *F04C 2240/80* (2013.01)

(58) Field of Classification Search
USPC ..... 418/55.1–55.6, 57, 88, 94, 99, 151, 418/270, DIG. 1
See application file for complete search history.

(56) References Cited

U.S. PATENT DOCUMENTS 5,370,513 A 12/1994 Fain
5,522,715 A 6/1996 Watanabe et al.
(Continued)

FOREIGN PATENT DOCUMENTS

JP 09-105391 A 4/1997
JP 10047269 A * 2/1998 ..... F04C 18/02
(Continued)

OTHER PUBLICATIONS

Chinese Notification on Grant of Patent Right for Utility Model and Notification on Patent Registration Formalities regarding Application No. 201020680126.5, dated May 5, 2011. Translations provided by Unitalen Attorneys at Law.
(Continued)

*Primary Examiner* — Theresa Trieu
(74) *Attorney, Agent, or Firm* — Harness, Dickey & Pierce, P.L.C.

(57) ABSTRACT

A thrust plate for a compressor may include first and second ends and a feed hole. The first end may include a thrust surface. The second end may include a lubricant accumulation feature. The feed hole may extend between the lubricant accumulation feature and the thrust surface to provide communication therebetween. The feed hole may be angled relative to a longitudinal axis of the thrust plate such that lubricant flows through the feed hole from the lubricant accumulation feature to the thrust surface.

20 Claims, 4 Drawing Sheets

(51) Int. Cl.

| | |
|---|---|
| ***F04C 2/00*** | (2006.01) |
| ***F04C 18/00*** | (2006.01) |
| ***F04C 29/02*** | (2006.01) |
| ***F04C 18/02*** | (2006.01) |
| ***F04C 23/00*** | (2006.01) |

(56) References Cited

U.S. PATENT DOCUMENTS

| | | | | |
|---|---|---|---|---|
| 5,810,573 | A * | 9/1998 | Mitsunaga et al. | 418/55.6 |
| 2010/0307173 | A1 | 12/2010 | Guo et al. | |

FOREIGN PATENT DOCUMENTS

| | | | | | |
|---|---|---|---|---|---|
| JP | 2009197692 | A * | 9/2009 | ..... | F04C 18/02 |
| KR | 20100104197 | A * | 9/2010 | ..... | F04C 18/02 |

OTHER PUBLICATIONS

International Search Report regarding Application No. PCT/US2011/066762, mailed Aug. 28, 2012.

Written Opinion of the International Searching Authority regarding Application No. PCT/US2011/066762, mailed Aug. 28, 2012.

* cited by examiner

THRUST PLATE FOR A HORIZONTAL SCROLL COMPRESSOR AND A HORIZONTAL SCROLL COMPRESSOR HAVING THE SAME

CROSS-REFERENCE TO RELATED APPLICATIONS

This application is a 371 U.S. National Stage of International Application No. PCT/US2011/066762, filed on Dec. 22, 2011, which claims the benefit and priority of Chinese Patent Application Patent Application 2010206801265, filed Dec. 22, 2010. The entire disclosures of the above applications are incorporated herein by reference.

FIELD

The present disclosure relates to a thrust plate for a compressor.

BACKGROUND

This section provides background information related to the present disclosure and is not necessarily prior art.

A scroll compressor generally may be classified into a vertical scroll compressor and a horizontal scroll compressor. In the scroll compressor, fluid may be compressed by relative motion between an orbiting scroll member and a non-orbiting scroll member. A thrust plate is provided on a side of an end plate of the orbiting scroll member to axially support the orbiting scroll member. Lubrication between mating surfaces of the end plate and thrust plate facilitates reliable and efficient operation of the compressor.

SUMMARY

In one form, the present disclosure provides a thrust plate for a compressor that may include first and second ends and a feed hole. The first end may include a thrust surface. The second end may include a lubricant accumulation feature. The feed hole may extend between the lubricant accumulation feature and the thrust surface to provide communication therebetween. The feed hole may be angled relative to a longitudinal axis of the thrust plate such that lubricant flows through the feed hole from the lubricant accumulation feature to the thrust surface.

In some embodiments, the lubricant accumulation feature may include a recess formed in the second end.

In some embodiments, a baffle may be disposed at least partially in the recess and adjacent the feed hole.

In some embodiments, the lubricant accumulation feature may include a baffle disposed adjacent the feed hole at the second end.

In some embodiments, the thrust surface may include an annular groove in communication with the feed hole.

In some embodiments, the feed hole may be angled such that lubricant flows through the feed hole via a gravitational force.

In some embodiments, a first end of the feed hole disposed adjacent the first end is disposed radially inward relative to a second end of the feed hole disposed adjacent the second end.

In some embodiments, the thrust surface may be an annular surface and a central aperture extends through the first and second ends.

In another form, the present disclosure provides a compressor that may include orbiting and non-orbiting scrolls, a drive shaft, a bearing housing, and a thrust plate. The drive shaft may drive the orbiting scroll for orbital motion relative to said non-orbiting scroll. The bearing housing rotatably supporting said drive shaft. The thrust plate may be mounted to the bearing housing and axially support the orbiting scroll. The thrust plate may include a thrust surface, a lubricant accumulation feature, and a feed hole extending between the lubricant accumulation feature and the thrust surface to provide communication therebetween. The feed hole may be angled relative to a longitudinal axis of the drive shaft such that lubricant flows through the feed hole from the lubricant accumulation feature to the thrust surface.

In some embodiments, the drive shaft may include a counterweight that rotates within a cavity and transfers lubricant from the cavity to the lubricant accumulation feature.

In some embodiments, the drive shaft includes an aperture providing lubricant to the cavity.

In some embodiments, the thrust surface may include an annular surface and a central aperture may extend through the first and second ends.

In some embodiments, the compressor may include an oil separator disposed inside of a shell of the compressor. The oil separator may be in communication with a passage through the drive shaft via an oil return conduit.

In some embodiments, the compressor may be a horizontal compressor.

In some embodiments, a distal end of the counterweight may be close to an inner wall of the main bearing housing.

The thrust plate and the horizontal scroll compressor may have the following advantages: (1) the thrust plate has relatively simple structure and low manufacturing cost; (2) the lubrication oil may be fed to the thrust surface more continuously and constantly; (3) by using the centrifugal force of the counterweight and the weight of the lubrication oil, the lubrication oil may be fed in a simple and reliable manner. The above advantages may be realized without significantly increasing a load on the compressor.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
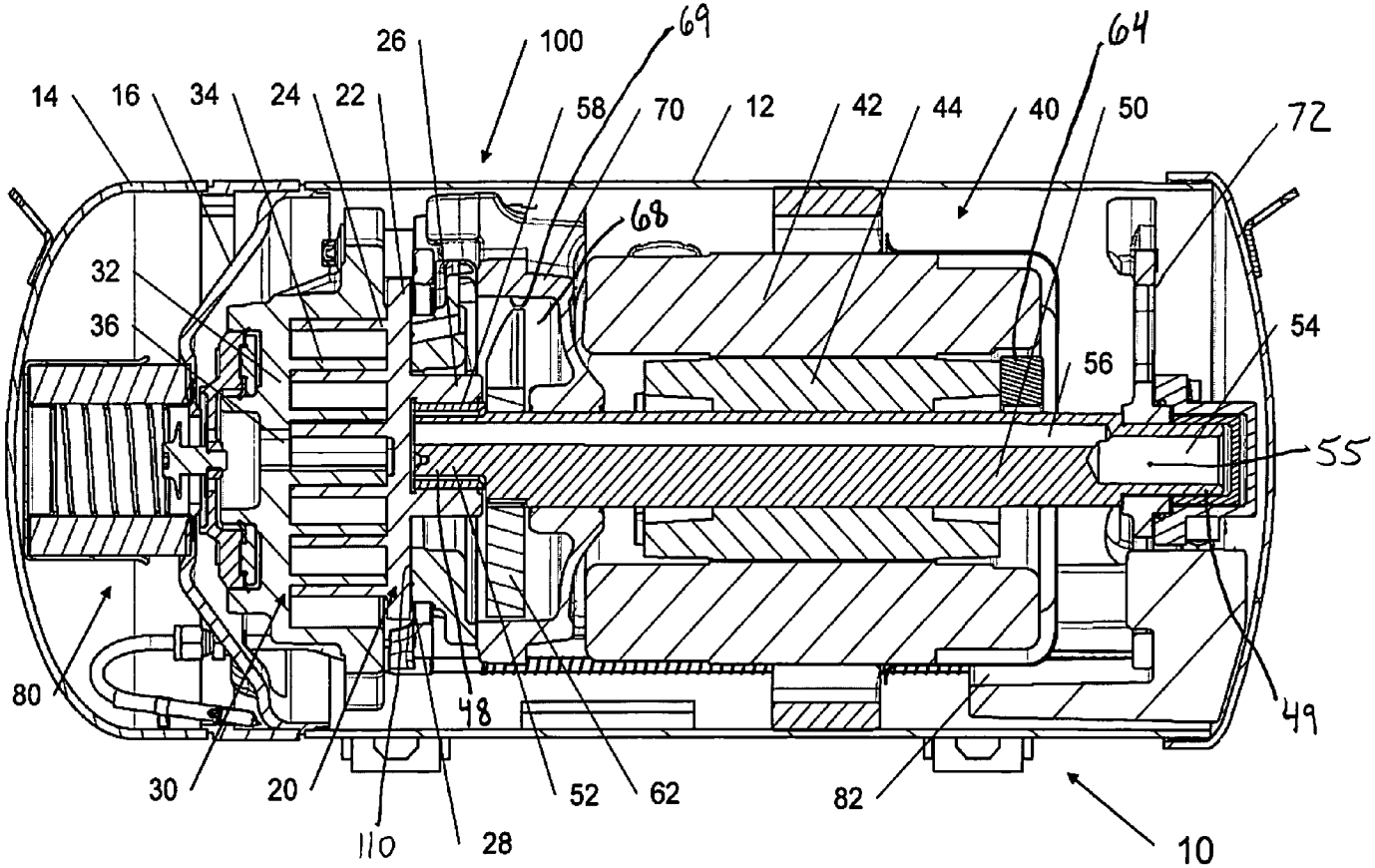
FIG. 1 is a cross-sectional view of a compressor having a thrust plate according to the principles of the present disclosure.

The following description of exemplary embodiments is only illustrative and should not be construed to limit the application and use of the present disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The horizontal scroll compressor (also refer to as "scroll compressor" or "compressor" hereinafter) 10 includes a substantially cylindrical hermetical shell 12. An inlet fitting (not shown) for drawing gaseous refrigerant with low pressure is provided on the shell 12. An end cap 14 is fixedly provided at an end of the shell 12. An outlet fitting (not shown) for discharging compressed refrigerant is provided on the end cap 14. A partition 16 extending transverse to the axial direction of the shell 12 (extending in a substantially vertical direction in FIG. 1) is provided between the shell 12 and the end cap 14, so as to partition the inner space in the compressor into a high side and a low side. The space between the end cap 14 and the partition 16 forms the high side space, and the space between the partition 16 and the shell 12 forms the low side space.

An orbiting scroll member 20 and a non-orbiting scroll member 30 serving as a compressing mechanism, and a motor 40 and a drive shaft 50 serving as a driving mechanism are provided in the shell 12. The compressing mechanism may be driven by the driving mechanism and be supported by a main bearing housing 70 which may be fixed to the shell 12 at a plurality of points in any desirable manner such as riveting.

The orbiting scroll member 20 includes an end plate 22. One surface of the end plate 22 is provided with a spiral vane 24. Another surface of the end plate 22 may be provided with a cylindrical hub 26. The non-orbiting scroll member 30 includes an end plate 32 and a spiral vane 34. The spiral vane 24 of the orbiting scroll member 20 is engaged with the spiral vane 34 of the non-orbiting scroll member 20. When the orbiting scroll member 20 is orbits relative to the non-orbiting scroll member 20, a volume of a fluid pocket formed therebetween gradually decreases as it moves from a radially outer position to a radially inner position.

The motor 40 includes a stator 42 and a rotor 44. The stator 42 may be fixedly connected to the shell 12. The rotor 44 may be fixedly connected with the drive shaft 50 and rotatable relative to the stator 42.

A first end 48 of the drive shaft 50 may be provided with a crank pin 52 and a first counterweight 62. A second end 49 of the drive shaft 50 may be provided with a second counterweight 64. The first counterweight 62 and the second counterweight 64 may be fixedly provided on the drive shaft 50 and thus may be rotated integrally with the rotated drive shaft 50. The drive shaft 50 may be rotatably supported by a bearing provided in a first bearing housing 70, and a second bearing housing 72. The first counterweight 62 may be rotate within a cavity 68 defined by the first bearing housing 70 and may be sized such that radially outer portion of the first counterweight 62 may be in close proximity to an inner wall 69 of the first bearing housing 70.

The second end 49 of the drive shaft 50 may include a concentric hole 54, a radially extending hole 55, and an eccentric hole 56. The concentric hole 54 may be in communication with the radially extending hole 55 and the eccentric hole 56. The radially extending hole 55 may extend from the concentric hole 54 through an outer periphery of the drive shaft 50. The eccentric hole 56 may extend from the concentric hole 54 through the first end of the drive shaft 54.

The crank pin 52 of the drive shaft 50 is inserted into the hub 26 of the orbiting scroll member 20 via a bushing 58 to rotatably drive the orbiting scroll member 20. When the orbiting scroll member 20 is moved relative to the non-orbiting scroll member 30, the fluid pocket between the orbiting scroll member 20 and the non-orbiting scroll member 30 is move from the radial outer position to the radially inner position of the non-orbiting scroll member 30 and thus is compressed. The compressed fluid is discharged from a gas discharging port 36 that may be provided at or near the center of the end plate 32 of the non-orbiting scroll member 30.

A thrust plate 100 may be provided between the orbiting scroll member 20 and the first bearing housing 70 such that the first counterweight 62 may be located between the thrust plate 100 and the first bearing housing 70. The thrust plate 100 may be mounted to the main bearing housing 70. A thrust surface 110 of the thrust plate 100 may contact a thrust surface 28 of the end plate 22 of the orbiting scroll member 20, to axially support the orbiting scroll member 20 for orbital motion relative to the non-orbiting scroll member 30. During rotation of the drive shaft 50, there is relative movement between the thrust surface 28 of the end plate 22 of the orbiting scroll member 20 and the thrust surface 110 of the thrust plate 100. Therefore, the thrust surfaces 28, 110 may be lubricated to reduce the friction therebetween, so as to prevent seizure of the orbiting scroll member 20 or excess abrasion therebetween.

An oil separator 80 may be disposed downstream of the gas discharging port 36 of the non-orbiting scroll member 30. While in the embodiment illustrated in FIG. 1, the oil separator 80 is disposed inside of the shell 12, in some embodiments, the oil separator 80 could be disposed outside of the shell 12. The lubrication oil contained in the compressed refrigerant may be separated from a working fluid by the oil separator 80. The lubrication oil separated by the oil separator 80 may be returned to the concentric hole 54 at the second end 49 of the drive shaft 50 via an oil return pipeline 82 that extends along a lower portion of the shell 12. The oil return pipeline 82 may be in communication with the concentric hole 54 via the radially extending hole 55. During rotation of the drive shaft 50, the oil may be pumped through the eccentric hole 56 from the second end 49 to the first end 48 of the drive shaft 50 and may be fed between the crank pin 52 and the bushing 58 and between the bushing 58 and the hub 26 of the orbiting scroll member 20, and then to the thrust surfaces 28, 110 which will be described later. A portion of the lubricant may mix with the working fluid, and may be discharged through the discharge port 36 to the oil separator 80 with the compressed working fluid. together with the compressed refrigerant to separate the oil from the refrigerant.

Figure 2C:
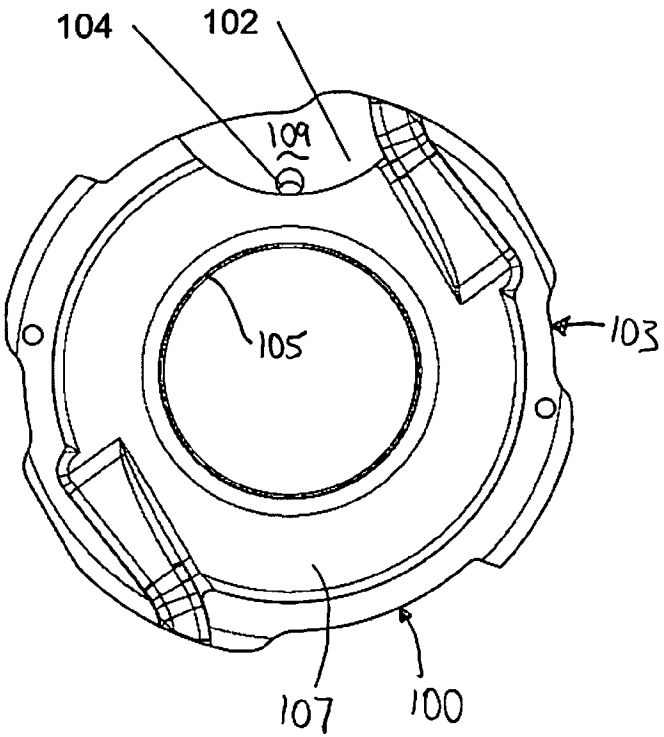
FIG. 2C is a back view of the thrust plate of FIG. 1.
Figure 2B:
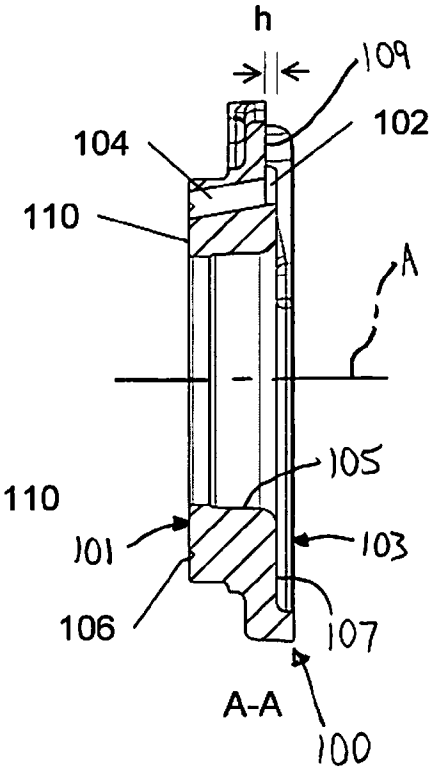
FIG. 2B is a cross-sectional view of the thrust plate taken along line A-A in FIG. 2A.
Figure 2A:
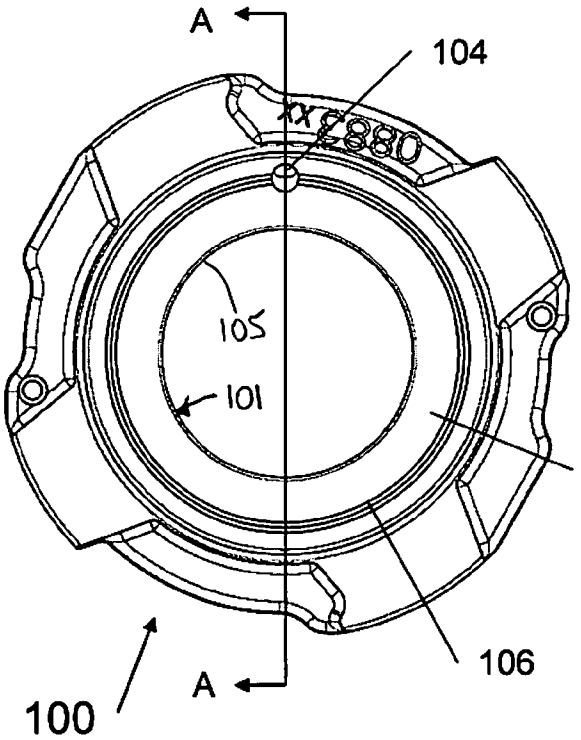
FIG. 2A is a front view of the thrust plate of FIG. 1.

As shown in FIGS. 2A-2C, the thrust plate 100 may include a first end 101, a second end 103, and a central aperture 105 extending axially through the first and second ends 101, 103. An annular recess 107 may be formed in the second end 103 and may be substantially coaxial with the central aperture 105. The first end 101 may include a thrust surface 110 having an annular groove 106 formed therein. The annular groove 106 may be substantially coaxial with the central aperture 105. The thrust surface 110 may axially support the thrust surface 28 of the orbiting scroll member 20 for orbital movement of the orbiting scroll member 20 relative to the non-orbiting scroll member 30. The crank pin 52 and hub 26 may extend at least partially through the central aperture 105.

The second end 103 may be attached to the first bearing housing 70 and may include a recess 102 formed therein. The recess 102 may include an arc shape and may be in communication with the annular recess 107 and the cavity 68 in the first bearing housing 70. The recess 102 may be machined (e.g., milled) or molded into the thrust plate 100. An axially facing surface 109 of the recess 102 may be axially offset from the second end 103 by a predetermined distance h. While the recess 102 is shown in the figures including a generally arc shape, it will be appreciated that the recess 102 could include any suitable shape such as triangular, for example.

Figure 3:
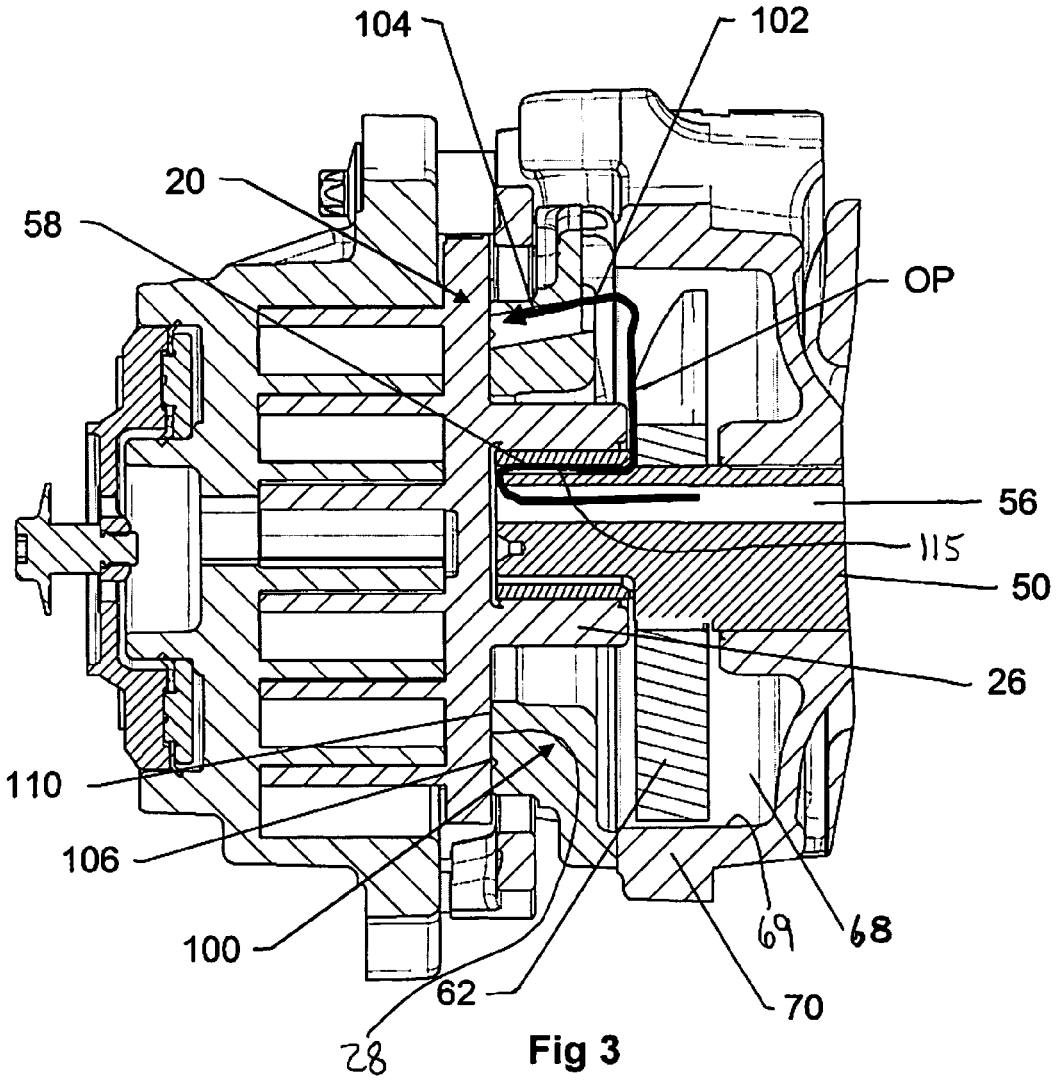
FIG. 3 is a partial cross-sectional view of the compressor.

An oil feeding hole 104 may be in communication with the recess 102 and the annular groove 106 and may extend from the recess 102 through the thrust surface 110. The oil feeding hole 104 may be angled relative to a longitudinal axis A of the thrust plate 100 such that gravity may cause fluid to flow through the oil feeding hole 104 from the recess 102 to the thrust surface 110. In some embodiments, the thrust plate 100 may be mounted to the first bearing housing 70 such that the recess 102 is disposed vertically above the longitudinal axis A, as shown in FIGS. 1 and 3. In such embodiments, the oil feeding hole 104 may be disposed at an angle relative to the longitudinal axis A of the thrust plate 100 such that a first portion of the oil feeding hole 104 disposed at the second end 103 may be further away from the longitudinal axis A than a second portion of the oil feeding hole 104 disposed at the first end 101. In this manner, oil may accumulate in the recess 102 and drain through the oil feeding hole 104 to the thrust surface 110 and annular groove 106. The annular groove 106 may allow oil received from the recess 102 to be distributed over some or all of the thrust surface 106.

With reference to FIGS. 1-3, operation of the compressor 10 and thrust plate 100 will be described in detail. During operation of the compressor 10, the motor 40 may cause rotation of the drive shaft 50 which causes the orbiting scroll member 20 to orbit relative to the non-orbiting scroll member 30. While the drive shaft 50 is rotating, the lubrication oil from the eccentric hole 56 of the drive shaft 50 may be pumped to the first end 48 of the drive shaft 50, and then flow out of the eccentric hole 56 and into a space 115 between the crank pin 52 and the hub 26 (e.g., between the crank pin 52 and the bushing 58 or between the bushing 58 and the hub 26). The oil may then flow into the cavity 68 between the first bearing housing 70 and the thrust plate 100 and may accumulate in the cavity 68.

As described above, the first counterweight 62 may be fixedly provided at the first end 48 of the drive shaft 50 and may be located between the thrust plate 100 and the first bearing housing 70. That is, the first counterweight 62 may be located in the cavity 68. With the rotation of the drive shaft 50, the first counterweight 62 is also rotated. Since the radially distal end of the first counterweight 62 is close to the inner wall 69 of the first bearing housing 70 and the recess 102 of the thrust plate 100 faces the first counterweight 62, when the first counterweight 62 is rotated, the lubrication oil accumulated in the cavity 68, especially at the bottom of the cavity 68, is stirred by the first counterweight 62 and splashed into the recess 102 of the thrust plate 100 and accumulated therein. The lubrication oil accumulated in the recess 102 flows through the oil feeding through hole 104 under gravity, and thus flows from the second end 103 of the thrust plate 100 to the thrust surface 110 at the first end 101 of the thrust plate 100. The oil may then flow over some or all of the annular oil groove 106 in the thrust surface 110 under the gravity and the relative movement between the orbiting scroll member 20 and the thrust plate 100. In this way, the some or all of the thrust surface 110 may be lubricated. The arrow OP of FIG. 3 schematically shows the moving path of the lubrication oil from the eccentric hole 56 to the annular groove 106 and thrust surface 110.

Testing has demonstrated that the principles of the present disclosure provide the lubrication oil to the thrust surface 110 more continuously and constantly. A flow rate of oil to the annular groove 106 and thrust surface 110 may be determined by the depth h of the recess 102 and by the surface area of the recess 102. In general, increasing the volume of the recess 102 may increase the flow rate of oil to the thrust surface 110.

Figure 4C:
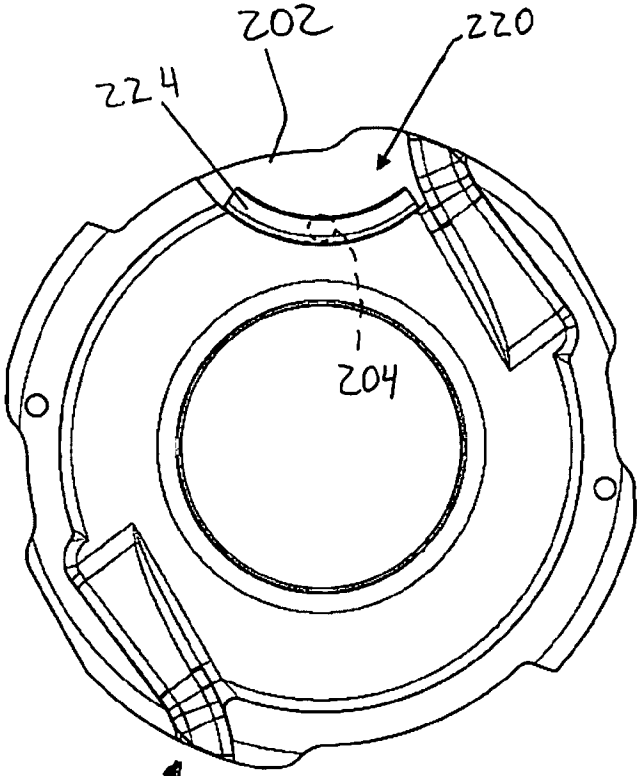
FIG. 4C is a back view of the thrust plate of FIG. 4A.
Figure 4B:
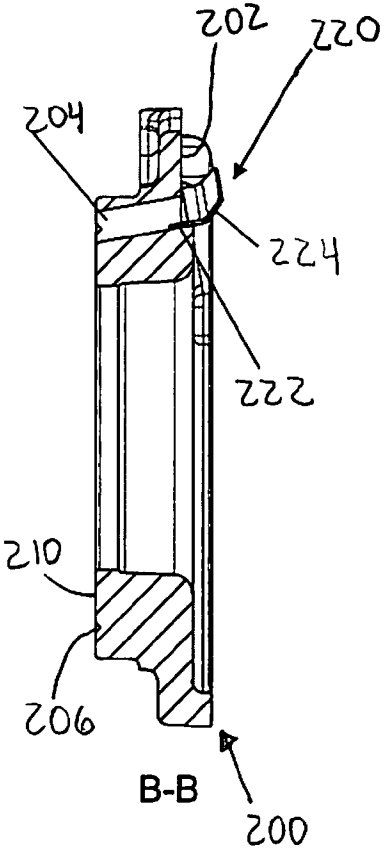
FIG. 4B is a cross-sectional view of the thrust plate taken along line B-B in FIG. 4A.
Figure 4A:
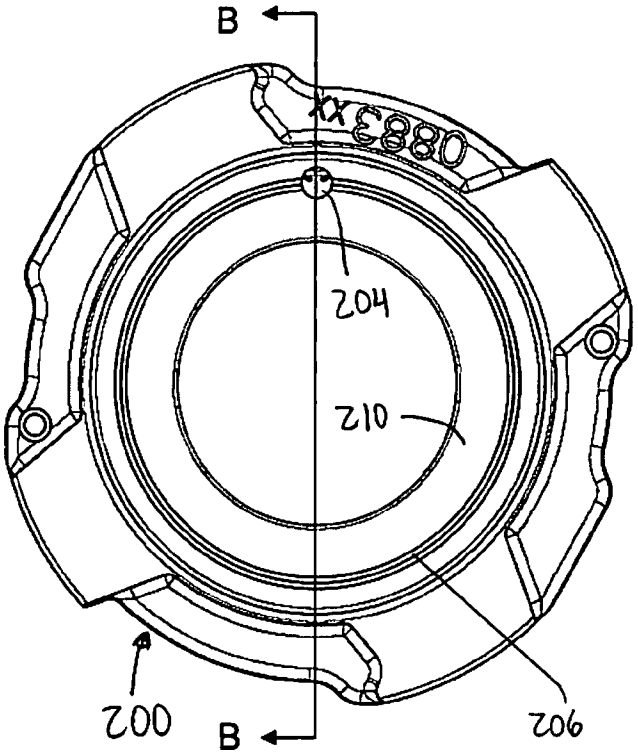
FIG. 4A is a front view of another thrust plate according to the principles of the present disclosure.

With reference to FIGS. 4A-4C, another thrust plate 200 is provided. The structure and function of the thrust plate 200 may be substantially similar to that of the thrust plate 100 described above, apart from any exceptions noted below. The thrust plate 200 may be incorporated in to the compressor 10 in the manner described above.

The thrust plate 200 may include recess 202 having an oil feeding hole 204 and a baffle 220. The recess 202 and oil feeding hole 204 may be substantially similar to the recess 102 and oil-feeding through-hole 104 described above. The baffle 220 may include an inserted part 222 inserted into the oil feeding through hole 204 and a baffle part 224 bending upwards from the inserted part 222. The baffle part 224 may be generally U-shaped and may act as a scoop to collect oil and funnel the oil into the oil feeding hole 204. In some embodiments, the baffle 220 could be constructed without the insert part 222, and the baffle part 224 may be secured directly to the thrust plate 200 at or near the oil feeding hole 204.

It should be appreciated that the baffle 220 may be used in addition to or as an alternative to the recess 202 to accumulate oil splashed by the counterweight 62 and provide oil to the oil feeding hole 204. In some embodiments, the baffle 220 may prevent or restrict oil from being splashed directly through the oil feeding hole 204, thereby allowing for better control of the oil flow rate to an annular groove 206 and thrust surface 210 of the thrust plate 200.

While various embodiments of the present disclosure have been described in detail herein, it should be understood that the present disclosure is not limited to the specific embodiments described in detail and illustrated herein, those skilled in the art can make other variants and modifications without departing from the principles and scope of the present disclosure. All these variants and modifications fall into the scope of the present disclosure. Furthermore, some or all of the elements described herein can be replaced by other structurally or functionally equivalent elements.

What is claimed is:

1. A thrust plate for a compressor comprising:
a first end including a thrust surface;
a second end including a lubricant accumulation feature;
a feed hole extending between the lubricant accumulation feature and the thrust surface to provide communication therebetween, said feed hole being angled relative to a longitudinal axis of the thrust plate such that lubricant flows through said feed hole from said lubricant accumulation feature to said thrust surface.

2. The thrust plate of claim 1, wherein said lubricant accumulation feature includes a recess formed in said second end.

3. The thrust plate of claim 2, further comprising a baffle disposed at least partially in said recess and adjacent said feed hole.

4. The thrust plate of claim 1, wherein said lubricant accumulation feature includes a baffle disposed adjacent said feed hole at said second end.

5. The thrust plate of claim 1, wherein said thrust surface includes an annular groove in communication with the feed hole.

6. The thrust plate of claim 1, wherein said feed hole is angled such that lubricant flows through said feed hole via a gravitational force.

7. The thrust plate of claim 6, wherein a first end of said feed hole disposed adjacent said first end is disposed radially inward relative to a second end of said feed hole disposed adjacent said second end.

8. The thrust plate of claim 1, wherein said thrust surface is an annular surface and a central aperture extends through said first and second ends.

9. A compressor comprising:
a non-orbiting scroll;
an orbiting scroll;
a drive shaft driving said orbiting scroll for orbital motion relative to said non-orbiting scroll;
a bearing housing rotatably supporting said drive shaft;
a thrust plate mounted to said bearing housing and axially supporting said orbiting scroll, said thrust plate including a thrust surface, a lubricant accumulation feature, and a feed hole extending between the lubricant accumulation feature and the thrust surface to provide communication therebetween, said feed hole being angled relative to a longitudinal axis of said drive shaft such that lubricant flows through said feed hole from said lubricant accumulation feature to said thrust surface.

10. The compressor of claim 9, wherein said drive shaft includes a counterweight that rotates within a cavity and transfers lubricant from said cavity to said lubricant accumulation feature.

11. The compressor of claim 10, wherein said drive shaft includes an aperture providing lubricant to said cavity.

12. The compressor of claim 9, wherein said lubricant accumulation feature includes a recess formed in an end of said thrust plate opposite said thrust surface.

13. The compressor of claim 12, further comprising a baffle disposed at least partially in said recess and adjacent said feed hole.

14. The compressor of claim 9, wherein said lubricant accumulation feature includes a baffle disposed adjacent said feed hole.

15. The compressor of claim 9, wherein said thrust surface includes an annular groove in communication with the feed hole.

16. The compressor of claim 9, wherein said feed hole is angled such that lubricant flows through said feed hole via a gravitational force.

17. The compressor of claim 16, wherein a first end of said feed hole disposed adjacent said first end is disposed radially inward relative to a second end of said feed hole disposed adjacent said second end.

18. The compressor of claim 9, wherein said thrust surface is an annular surface and a central aperture extends through said first and second ends.

19. The compressor of claim 9, further comprising an oil separator disposed inside of a shell of the compressor and in communication with a passage through said drive shaft via an oil return conduit.

20. The compressor of claim 9, wherein the compressor is a horizontal compressor.

* * * * *